US007207370B2

(12) United States Patent
Snyder et al.

(10) Patent No.: US 7,207,370 B2
(45) Date of Patent: Apr. 24, 2007

(54) RETRACTABLE SAFETY BARRIER

(75) Inventors: Ronald P. Snyder, Peosta, IA (US); Jason D. Miller, Sherrill, IA (US); Donald P. Grant, Dubuque, IA (US); Paul J. Maly, Mequon, WI (US); Mike Gallenberger, Thiensville, WI (US)

(73) Assignee: Rite-Hite Holding Corporation, Milwaukee, WI (US)

( * ) Notice: Subject to any disclaimer, the term of this patent is extended or adjusted under 35 U.S.C. 154(b) by 250 days.

(21) Appl. No.: 10/809,119

(22) Filed: Mar. 25, 2004

(65) Prior Publication Data

US 2005/0211389 A1 Sep. 29, 2005

(51) Int. Cl.
*E06B 9/08* (2006.01)

(52) U.S. Cl. ..... 160/23.1; 160/293.1; 160/294; 242/380

(58) Field of Classification Search ..... 160/264, 160/290.1, 291, 293.1, 294, 305, 23.1, 24, 160/340; 242/380
See application file for complete search history.

(56) References Cited

U.S. PATENT DOCUMENTS

| | | | | | |
|---|---|---|---|---|---|
| 516,486 | A | * | 3/1894 | Hatrshom | 160/294 |
| 778,228 | A | | 12/1904 | Dodge et al. | |
| 824,930 | A | * | 7/1906 | Hopkins | 160/287 |
| 1,477,159 | A | * | 12/1923 | Zinser | 160/294 |
| 1,652,186 | A | | 12/1927 | Strauss | |
| 1,666,508 | A | | 4/1928 | Sawyer | |
| 1,828,296 | A | | 10/1931 | Sawyer | |
| RE18,940 | E | * | 9/1933 | Traut | 160/264 |
| 2,088,046 | A | | 7/1937 | White | |
| 2,295,205 | A | | 9/1942 | Fraser | |
| 2,678,691 | A | | 5/1954 | Rust | |
| 3,090,425 | A | | 5/1963 | Carto | |
| 3,115,182 | A | | 12/1963 | Bobbitt | |
| 3,146,824 | A | * | 9/1964 | Veilleux | 160/23.1 |
| 3,314,468 | A | | 4/1967 | Riedel | |
| 3,581,798 | A | * | 6/1971 | Malamed | 160/168.1 R |
| 3,803,943 | A | | 4/1974 | Woloszyk | |

(Continued)

OTHER PUBLICATIONS

Web page advertising DockStrap(TM) product from Gaylor Material Handling, dated May 14, 2002, 1 page.

(Continued)

*Primary Examiner*—Blair M. Johnson
(74) *Attorney, Agent, or Firm*—Hanley, Flight & Zimmerman LLC

(57) ABSTRACT

A retractable barrier includes a rollup or otherwise retractable panel that can extend between two spaced apart support members. When not in use, the panel can retract onto one of the support members to permit passage. The barrier provides substantial impact resistance by having the reactive force of the impact transfer directly between the barrier's retractable panel and its support members without having to rely on the strength of the panel's take-up roller or the strength of the roller's anti-rotation mechanism. This can be accomplished by having a slot-engaging stop member mounted directly to the panel itself. The stop member is preferably a pipe, rod, bar or some other vertically elongate member that can broadly distribute an impact reactive force over the height of the panel. In some embodiments, the barrier can be set for various doorway widths by simply repositioning the stop member's location on the retractable panel.

36 Claims, 5 Drawing Sheets

U.S. PATENT DOCUMENTS 4,356,668 A 11/1982 Wagner
5,005,827 A 4/1991 Steinbrecher
5,029,819 A * 7/1991 Kane ..... 256/24
5,050,846 A 9/1991 Goodman
5,078,197 A 1/1992 Weishar
5,118,056 A 6/1992 Jeanise
5,170,829 A 12/1992 Duncan et al.
5,271,183 A 12/1993 Hahn et al.
5,299,386 A 4/1994 Naegelli
5,353,859 A 10/1994 Oltahfer
5,459,963 A 10/1995 Alexander
5,503,211 A * 4/1996 Engi ..... 160/290.1
5,505,244 A 4/1996 Thumann
5,564,238 A 10/1996 Ellis
5,624,203 A 4/1997 Jackson et al.
5,636,679 A * 6/1997 Miller et al. ..... 160/317
5,649,396 A 7/1997 Carr
5,660,144 A 8/1997 Venti
5,690,317 A 11/1997 Sandsborg
5,752,557 A 5/1998 Crider
5,823,705 A 10/1998 Jackson et al.
5,875,597 A * 3/1999 Gingrich et al. ..... 52/239
6,056,038 A 5/2000 Foster et al.
6,186,274 B1 2/2001 Reynolds et al.
6,244,324 B1 * 6/2001 Quates et al. ..... 160/23.1
6,279,276 B1 8/2001 Knoll
6,375,164 B1 4/2002 Siegler et al.
6,375,165 B1 4/2002 Sherratt et al.
6,485,225 B1 11/2002 Baker
6,536,502 B2 * 3/2003 Britto et al. ..... 160/23.1
6,575,435 B1 6/2003 Kotzen
6,595,496 B1 7/2003 Langlie et al.
6,688,480 B1 2/2004 Denny
6,715,973 B2 4/2004 Faber et al.
6,733,204 B1 * 5/2004 Paniccia ..... 404/6
6,776,398 B1 8/2004 Tsai
6,807,999 B1 * 10/2004 Bowen et al. ..... 160/24
6,830,236 B2 12/2004 Lorenzo
2002/0170688 A1 11/2002 Daus et al.
2003/0016996 A1 1/2003 Gelfand et al.
2003/0079845 A1 5/2003 Stern, Jr.
2003/0111657 A1 6/2003 Green

OTHER PUBLICATIONS

Product Brochure showing safety products of JD Metalworks, dated Jul. 9, 2003, 8 pages.
Patent Cooperation Treaty, "International Search Report" Jun. 26, 2006. 2 pages.
Patent Cooperation Treaty, "Written Opinion" Jun. 26, 2006. 3 pages.

* cited by examiner

RETRACTABLE SAFETY BARRIER

BACKGROUND OF THE INVENTION

1. Field of the Invention

The subject invention generally pertains to retractable safety barriers and more specifically to a heavy-duty barrier whose design features make it particularly suitable for impeding heaving loads such as, for example, a forklift at a loading dock platform.

2. Description of Related Art

Many retractable safety barriers for doorways have been developed to help prevent children and pets from entering certain areas. To selectively open or block a doorway, some barriers include a rollup panel that can be unrolled to extend across and block the doorway. When not in use or to allow passage, the panel can wrap about a roller for storage along one side of the doorway. A few examples of retractable barriers with rollup panels are disclosed in U.S. Pat. Nos. 5,636,679; 5,690,317; 6,536,502; 5,505,244; and 6,056,038.

Once such a rollup panel is extended across a doorway, usually some type of locking mechanism helps prevent the panel from unwrapping any farther so that the child or pet is unable to force the panel open. Such locking mechanisms typically include a little tab or pawl that engages a ratchet or some other type of tooth or slotted wheel, which in turn is coupled to the roller about which the panel is wrapped. The tab or pawl engaging the wheel hopefully prevents the roller from releasing the panel any farther. This may work well for light duty applications involving children and pets; however, such barriers do not appear adequate for industrial applications.

In factories, for example, a forklift and other material handling equipment may need to travel near operating equipment such as machine tools (machining centers, turning centers, etc.). A permanent guardrail may prevent a forklift from striking the machine, but the guardrail may also interfere with material handling equipment trying to load and unload the machine of its work pieces.

Truck loading docks may also have a need for a retractable barrier. A barrier may help prevent dockworkers and material handling equipment from accidentally falling off the edge of the dock's elevated platform. The platform's height is about the same as that of an average truck bed. Although a door typically exists at the edge of the platform, the door's strength may be insufficient to withstand the impact of a forklift, or the door may be left open for various reasons. The door, for instance, may be left open simply because the weather is nice, and the workers inside would like to enjoy some fresh air. With the door open, however, the loading dock platform may create a safety problem.

Although costly massive safety gates have been used at loading docks, they can take up a lot of space even when they are opened to allow passage through the doorway. Even though they may be able to stop a slowly moving forklift, an impact can cause considerable damage to the gate due to the gate's limited ability to resiliently absorb the impact. Also, permanent or other conventional guarding may not be suitable for loading dock areas, as such guarding may interfere with operating the door, loading and unloading trucks, and operating a dock leveler that may be installed at the platform.

A dock leveler is often installed at the loading dock platform to compensate for a height difference that may exist between the platform and the bed of the truck. A dock leveler typically includes a deck that is hinged at its back edge to raise or lower its front edge to generally match the height of the truck bed. Often an extension plate or lip is pivotally coupled to the deck to bridge the gap between the deck's front edge and a back edge of the truck bed. The deck and extended lip provide a path for forklifts to travel between the loading dock platform and the truck bed, thus facilitating loading or unloading of the truck. Unfortunately, a conventional barrier or guardrail extending over the dock leveler may restrict the deck's upward pivotal motion.

Since a dock leveler and the adjacent door move in the area where guarding may be needed, it becomes challenging to provide the area with a barrier that is movable yet sufficiently strong to impede heavy material handling equipment. Thus, a need exists for a movable, heavy-duty industrial barrier, which is more compact in its stored position, is more capable of stopping a forklift without significant damage, and incorporates a more cost-efficient design.

SUMMARY OF THE INVENTION

In some embodiments, a retractable rollup barrier is provided with substantial impact resistance by having the reactive force of the impact transfer directly between the barrier's retractable panel and its vertical support members without having to rely on the strength of the panel's take-up roller or the strength of the roller's anti-rotation mechanism.

In some embodiments, a retractable rollup barrier includes a stop member that is carried by the rollup panel itself.

In some embodiments, the stop member is an elongate member, such as a pipe, rod or bar that broadly distributes an impact reactive force over the height of the rollup panel.

In some embodiments, the stop member comprises multiple separate members on the same vertical line. The separate members could be a series of pipes, rods, or bars that work together to broadly distribute an impact reactive force over the height of a retractable panel.

In some embodiments, a retractable rollup barrier can be set for various doorway widths by simply repositioning a stop member's location on the rollup panel.

In some embodiments, the extent to which a rollup panel can extend out from within a housing is limited by a thicker section of the panel being unable to fit through a narrower slot in one of the barrier's support members.

In some embodiments, a retractable panel includes reinforcing straps that greatly increase the panel's strength.

In some embodiments, the reinforcing straps of the retractable panel can be of a different color than the rest of the panel so that the panel is clearly visible when in use.

In some embodiments, the panel includes a large warning label that is visible from a distance so that people in the area can see that a drop-off hazard exists even though a closed dock door may disguise the danger.

In some embodiments, the rollup panel does not reach its full extension from within its housing until the panel experiences an impact. This feature allows a distal end of the panel to be readily hooked or unhooked from an anchored support member without the panel having to be pulled tightly against a hard stop to do so.

In some embodiments, a retractable barrier straddles a dock leveler.

In some embodiments, two anchor support members of a retractable barrier can serve as bollard-like members for protecting the lateral edges of a door from damage.

In some embodiments, a distal end of a retractable panel can retract and stow within a pocket of a support member housing to protect the distal end from damage and avoid interfering with traffic when the retractable barrier is not in use.

DESCRIPTION OF THE PREFERRED EMBODIMENT

Figure 1:
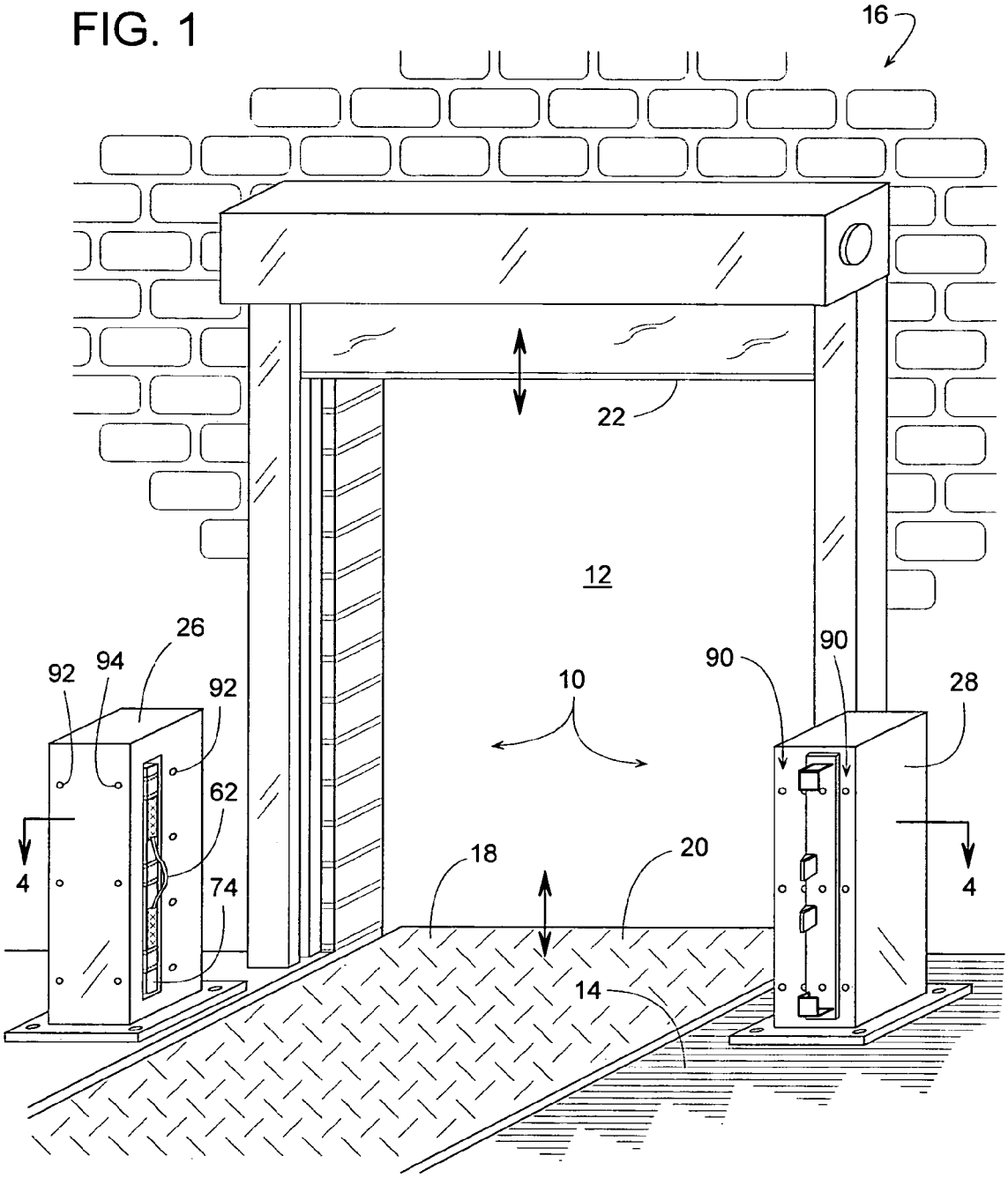
FIG. 1 is a perspective view of a retractable barrier in an open or stored position.
Figure 2:
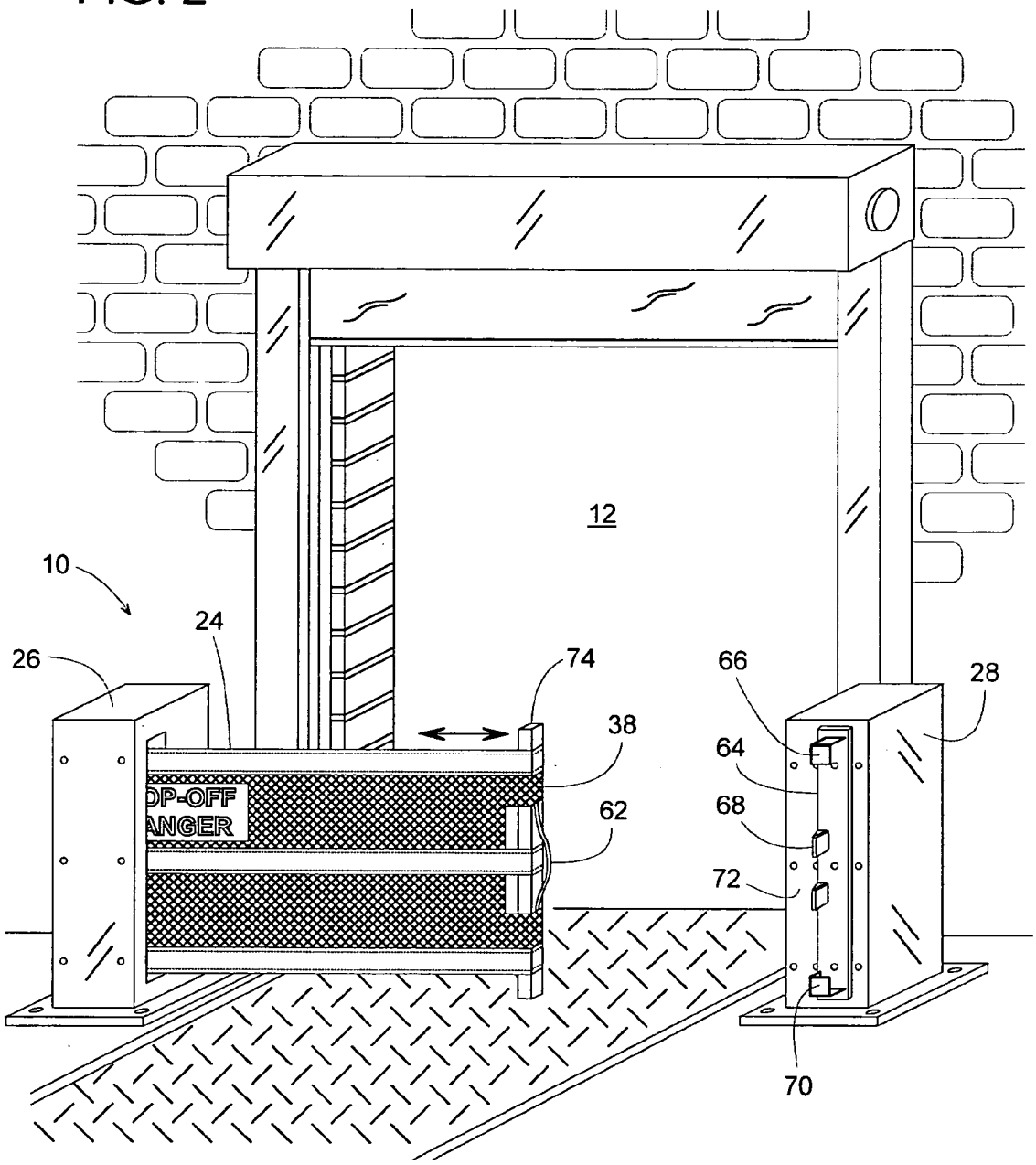
FIG. 2 is a perspective view of the retractable barrier of FIG. 1 but showing the barrier partially open.
Figure 3:
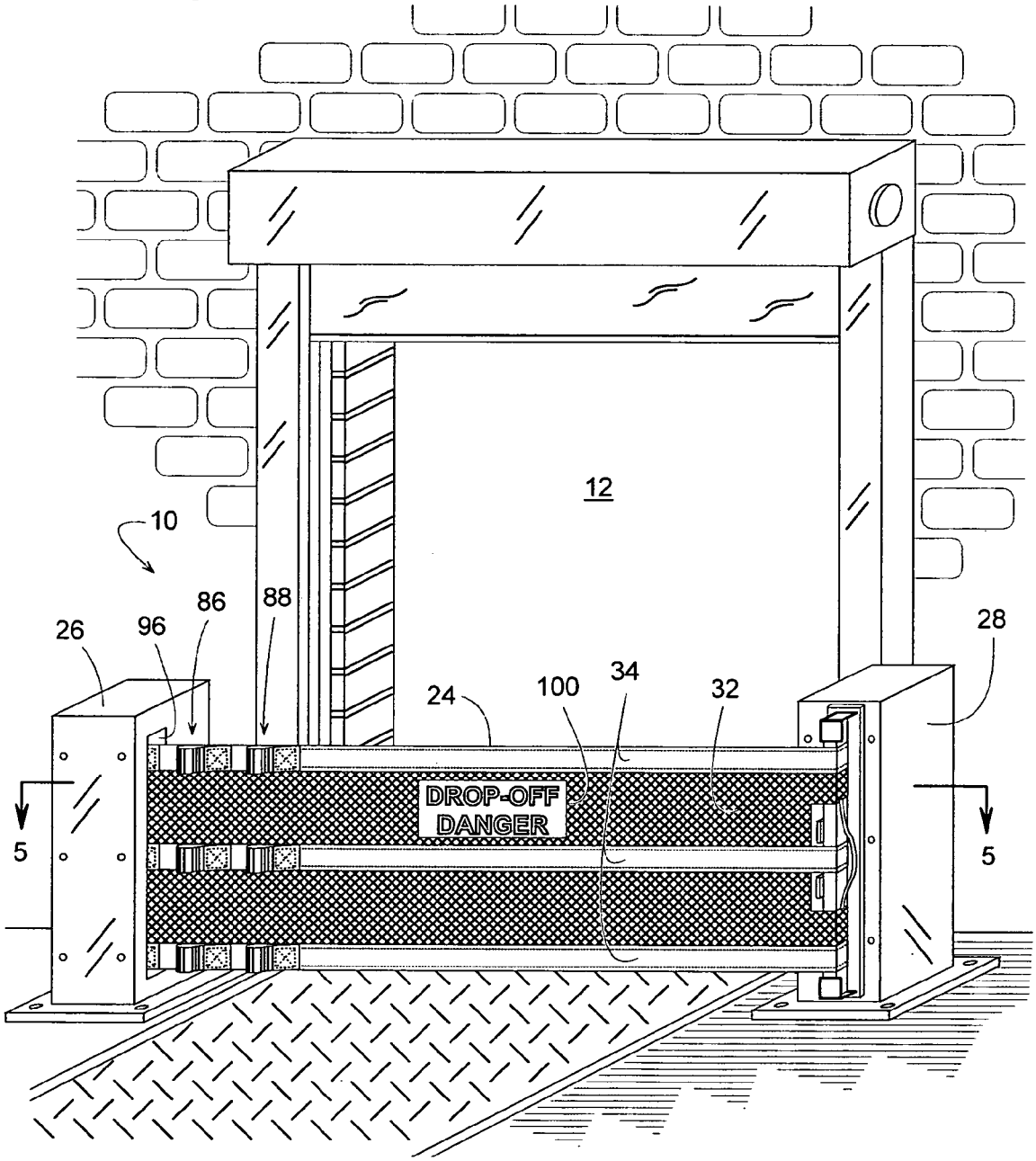
FIG. 3 is a perspective view of the retractable barrier of FIG. 1 but showing the barrier in a blocking position.

A retractable safety barrier 10 primarily intended for heavy duty industrial use is shown in FIGS. 1–3. The drawing figures show a view from within a building looking out through an open doorway 12. FIG. 1 shows barrier 10 in an open stored position, FIG. 3 shows barrier 10 in a blocking position, and FIG. 2 shows barrier 10 partway between its open and blocking positions.

Although barrier 10 is particularly suited for installation on an elevated platform 14 of a loading dock 16, barrier 10 can be readily applied to a broad range of heavy and light duty applications including, but not limited to, guarding machinery, guarding construction sites, restricting vehicular and pedestrian traffic, restraining cargo, restraining stock stored on high pallet racks, etc. Since the structure and function of various embodiments of barrier 10 may be similar regardless of the barrier's specific application, barrier 10 will be described with reference to its installation at loading dock 16.

Loading dock 16 may include a conventional dock leveler 18 whose pivotal deck 20 is presently shown at its cross-traffic position where the top surface of deck 20 is generally flush with platform 14. Dock 16 also includes a door 22 that can provide access to a truck parked at the dock. When a truck is not present, door 22 is normally closed and the need for barrier 10 may not be apparent; however, the strength of door 22 may be insufficient to withstand the impact of a forklift. In some cases, door 22 may be left open, as shown, even though no truck is present. If the weather outside is mild, for instance, door 22 may be left open to help ventilate the building.

Whether door 22 open or closed while no truck is present at the dock, platform 18 may create a falling hazard. A dockworker or material-handling vehicle, such as a forklift, may accidentally travel off the edge of platform 14 and fall onto the driveway just beyond doorway 12. To help prevent such an accident, some type of barrier could be installed across the doorway. The barrier, however, would need to be movable to permit loading or unloading a truck at the dock, not interfere with the operation of the door, permit the operation of the dock leveler, and not obstruct traffic in the vicinity of the dock.

To accomplish all of this, barrier 10 comprises a retractable panel 24 that can selectively extend and retract between two support members, which will be referred to as a first support member 26 and a second support member 28. Support members 26 and 28 may be attached to the floor of platform 18, attached to the wall of a building, and/or connected to adjacent structure (e.g., a doorway frame, door guide, etc.), wherein the adjacent structure is in turn attached to the building wall or the floor. In some cases, support members 26 and 28 are self-supporting members, wherein the members 26 and 28 are able to self-support their upper ends by simply having their lower ends be anchored to the floor. Members 26 and 28 could also be self-supporting in other ways, such as by being fixed to a structural member besides the floor, such as a wall adjacent the door opening. In some cases, support members 26 and 28 may be referred to as a "post," wherein the term "post" refers to a member whose primary source of support comes from the floor. In a currently preferred embodiment, the "retractable" feature of panel 24 is provided by panel 24 being a pliable roll-up panel that retracts by wrapping about a roller 30, wherein roller 30 is just one example of a take-up member. Other methods of retracting a panel include, but are not limited to, folding or translating interconnected sections of the panel.

Figure 4:
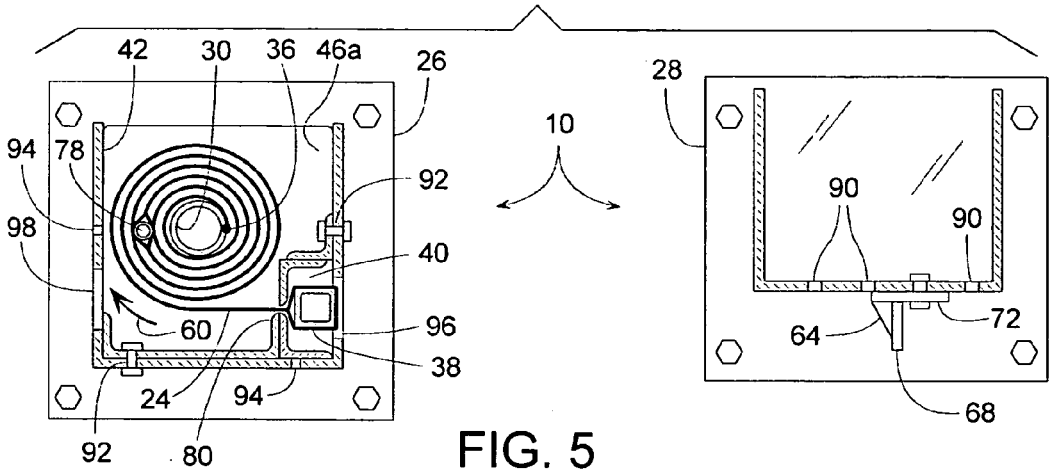
FIG. 4 is a cross-sectional view taken along line 4—4 of FIG. 1.
Figure 5:
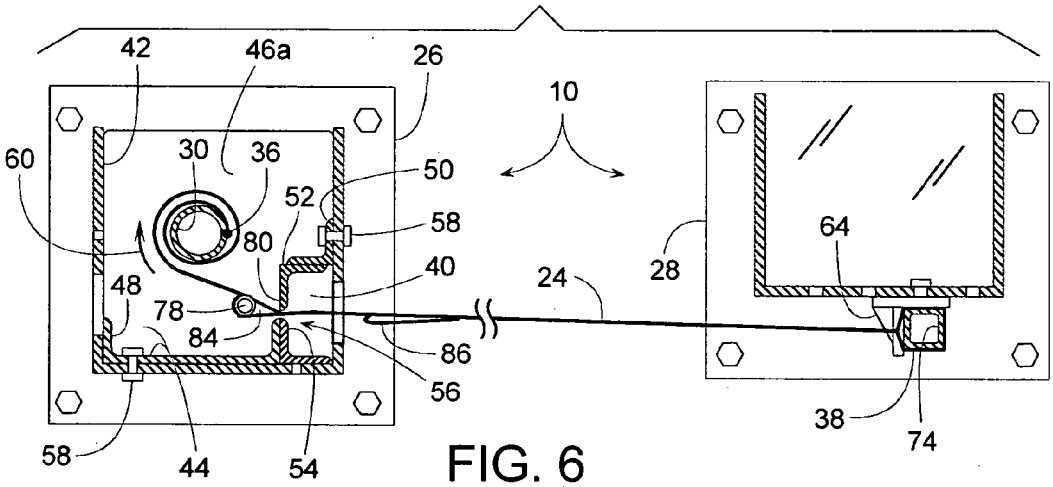
FIG. 5 is a cross-sectional view taken along line 5—5 of FIG. 3.

When panel 24 is pulled out from within first support member 26 and coupled to support member 28, as shown in FIGS. 3 and 5, panel 24 provides a barrier that helps prevent people and vehicles from accidentally falling off the edge of platform 14. When panel 24 retracts to its stored position of FIGS. 1 and 4, barrier 10 permits normal operation of the loading dock.

For the illustrated embodiment, of FIG. 3, panel 24 comprises a fabric web 32 reinforced by one or more straps 34 made nylon or some other a high-test belting material. A proximal end 36 (FIG. 5) of panel 24 connects to roller 30, and a distal end 38 of panel 24 can be selectively stored within a pocket 40 of first support member 26 or releasably coupled to second support member 28.

In some cases, referring to FIG. 5, first support member 26 comprises a housing 42 that contains a frame 44, which in turn supports roller 30. Frame 44 comprises matching upper and lower plates 46*a* and 46*b* (FIG. 8) with vertically elongate structural members 48, 50, 52 and 54 interposed between the two plates. Members 52 and 54 define a slot 56 and pocket 40. Members 48 and 50 enable conventional fasteners 58 to fasten frame 44 within housing 42. The orientation of frame 44 within housing 42 is based on which side of the doorway support member 26 is to be installed. This feature will be explained later.

Roller 30 is installed between the upper and lower plates 46*a* and 46*b* with panel 24 extending through slot 56. The main section of panel 24 is sufficiently thin to slide through slot 56 with the proximal end 36 of panel 24 being inside housing 42 and the distal end 38 of panel 24 being on the other side of slot 56.

To urge roller 30 to its stored position, roller 30 is preferably associated with a retracting mechanism, such as a conventional torsion spring 60, which is schematically depicted by an arrow that indicates the direction that spring 60 urges roller 30. When panel 24 disconnects from second support member 28, spring 60 acting upon roller 30 draws panel 28 into first support member 26 for storage.

Figure 6:
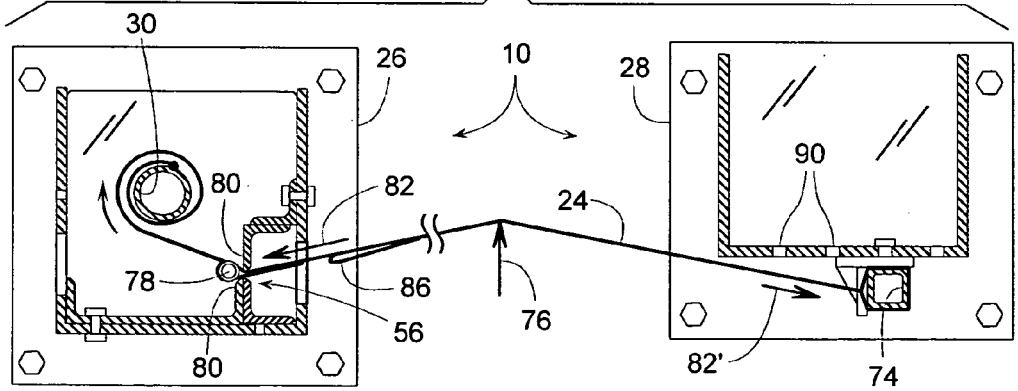
FIG. 6 is a cross-sectional view similar to FIG. 5 but showing the panel experiencing an impact.
Figure 7:
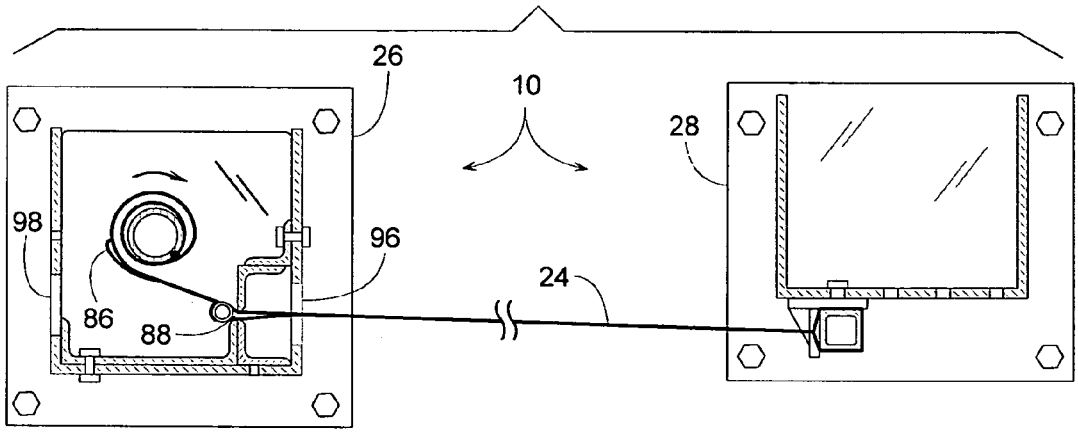
FIG. 7 is a cross-sectional view similar to FIG. 5 but with the barrier being set for a narrower doorway.

Referring to FIG. 2, to move barrier 10 to its blocking position, a pliable handle strap 62 on distal end 38 can be used to manually pull rollup panel 24 onto a hook assembly 64 of second support member 28. Hook assembly 64 includes one or more hooks, such as hooks 66, 68 and 70, which can be welded to a plate 72, which in turn is bolted to the main section of support member 28. To couple panel 24 to support member 28, the distal end 38 of panel 24 includes a metal bar 74 that can be hooked onto hook assembly 64. When panel 24 is in its stored position, bar 74 can stow within pocket 40 so as not to interfere with nearby traffic. When panel 24 is at its blocking position, bar 74 being vertically elongate helps distribute a force of impact 76 (FIG. 6) more evenly along the vertical span of panel 24.

To prevent impact force 76 from pulling panel 24 out from within first support member 26 or damaging roller 30 and its retracting mechanism, panel 24 carries a stop member 78, such as a pipe, bar, or other structure that is too thick to fit through slot 56. The structure surrounding slot 56 serves as a catch member 80 that prevents panel 24 from pulling stop member 78 out through slot 56. Thus, most of a reactive force 82 that opposes impact force 76 passes through panel 24 and first support member 26 and bypasses roller 30 due to the interaction between stop member 78 and catch member 80. Stop member 78 is preferably vertically elongate to evenly distribute reactive force 82 across the height of panel 24. It will be appreciated that other reactive forces, including for example reactive force 82', will be present in the system. Reactive force 82' is distributed vertically along the vertical span of panel 24, and is ultimately taken up by the second support member, by virtue of bar 74 and its interaction with hook assembly 64 in the current embodiment.

To fit barrier 10 to various width doorways, stop member 78 can be selectively inserted into one of several possible sleeves 84, 86 or 88 that are sewn or otherwise attached to panel 24. In this example, each sleeve comprises three vertically spaced apart loops formed of the same material as the panel's reinforcing straps. Stop member 78 is inserted in the selected sleeve while that sleeve is on the roller side of slot 56, thus the chosen sleeve determines how far panel 24 can extend out from within first support member 26.

The horizontal spacing between sleeves 84, 86 and 88 enables the length of barrier 10 to be adjusted in discrete increments equal to the spacing between adjacent sleeves. Finer length adjustments can be achieved by changing the location of where mounting plate 72 of hook assembly 64 is attached to support member 28. In selecting a location, second support member 28 includes several series of mounting holes 90 from which to choose. The actual spacing between adjacent sleeves of panel 24, and the spacing between adjacent vertical rows of holes 90 can vary depending on the design; however, in some embodiments sleeves 84, 86 and 88 are spaced at twelve-inch increments, and the rows of holes 90 are horizontally spaced at three-inch increments, so the extended length of panel 24 can be adjusted in three-inch increments over a length of 24 inches.

Figure 8:
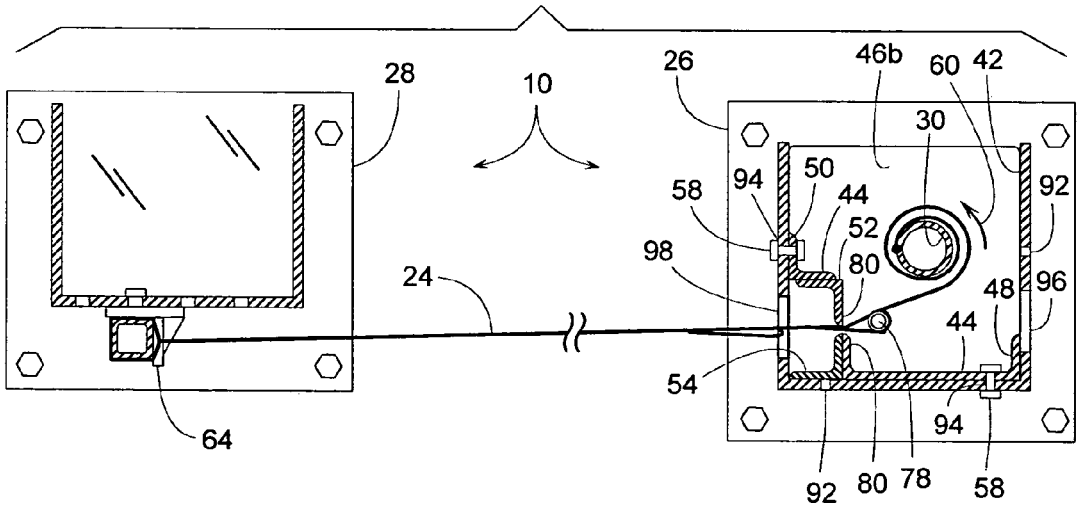
FIG. 8 is a cross-sectional view similar to FIG. 5 but with the location of the barrier's two support members being interchanged.

Minor reconfiguration of support members 26 and 28 allow interchanging their locations so that either support member can be on the right or left side of a doorway. For doorway 12, for example, support members 26 and 28 can be reinstalled as shown in FIG. 8. To do this, frame 44 is inverted on first support member 26, and hook assembly 64 is inverted on second support member 28. Hook assembly 64 can be inverted by using the same mounting holes 90. To permit the inverted installation of frame 44, however, housing 42 is provided with two sets of mounting holes 92 and 94 from which to choose. Housing 42 also includes a right-hand opening 96 and a similar left-hand opening 98 through either of which panel 24 can extend depending on the orientation of frame 44 within housing 42.

To warn others in the area of dock 16 that a drop-off hazard may exist, even when door 22 is closed, panel 24 may be of contrasting colors (e.g., red and yellow, black and yellow, etc.). In some embodiments, for example, straps 34 are yellow and web 32 is red. Alternatively or in addition to, a warning label 100 can be prominently displayed on panel 24 to suggest that a safety hazard exists.

Although the invention is described with reference to a preferred embodiment, it should be appreciated by those of ordinary skill in the art that various modifications are well within the scope of the invention. The barrier, for example, could comprise two retractable panels with one panel extending from one support member and the other panel extending the other support member. The two panels could then come together and connect to each other somewhere between the two support members. Each support member could have its own take-up member for its respective panel. Having the spring return force of one take-up member be less than that of the other could soften the impact of something striking the barrier. Storing two smaller panels on two support members rather than storing one large panel on a single support member could reduce the size of the larger of the two support members.

The invention claimed is:

1. A retractable baffler, comprising:

a first support member;

a take-up member supported by the first support member;

a second support member spaced apart from the first support member;

a retractable panel that includes a proximal end attached to the take-up member and a distal end that can be releasably coupled to the second support member, wherein the retractable panel can selectively retract onto the take-up member and extend out toward the second support member;

a vertically elongate stop member disposed on the retractable panel; and a catch member disposed on the first support member and being associated with the stop member such that the catch member impedes the movement of the stop member to limit an extent to which the retractable panel can extend out from the first support member.

2. The retractable baffler of claim 1, wherein the retractable panel is a roll-up panel, and the take-up member is a roller that can be rotated to selectively take up and pay out the roll-up panel.

3. The retractable baffler of claim 2, further comprising a retracting mechanism coupled to the roller for urging the roller to take up the rollup panel.

4. The retractable baffler of claim 3, wherein the retracting mechanism includes a spring.

5. The retractable baffler of claim 1, wherein the stop member is disposed on the retractable panel at an intermediated location between the proximal end and the distal end.

6. The retractable baffler of claim 1, wherein the first support member defines a slot whose surrounding structure is the catch member.

7. The retractable baffler of claim 1, further comprising a pliable strap handle attached to the distal end of the retractable panel.

8. The retractable baffler of claim 1, wherein the retractable panel is of contrasting colors to provide a warning.

9. The retractable baffler of claim 1, further comprising a warning label displayed on the retractable panel, wherein the warning label suggests that a safety hazard may exist.

10. A retractable barrier comprising:

a first support member;

a take-up member supported by the first support member;

a second support member spaced apart from the first support member;

a retractable panel that includes a proximal end attached to the take-up member and a distal end that can be releasably coupled to the second support member, wherein the retractable panel can selectively retract onto the take-up member and extend out toward the second support member;

a stop member disposed on the retractable panel, wherein the retractable panel defines a plurality of sleeves in which the stop member can be selectively inserted to adjust the extent to which the retractable panel can extend from the first support member; and a catch member disposed on the first support member and being associated with the stop member such that the catch member impedes the movement of the stop member to limit an extent to which the retractable panel can extend out from the first support member.

11. The retractable baffler of claim 10, wherein the retractable panel is a roll-up panel, and the take-up member is a roller that can be rotated to selectively take up and pay out the roll-up panel.

12. The retractable baffler of claim 10, further comprising a retracting mechanism coupled to the roller for urging the roller to take up the rollup panel.

13. The retractable baffler of claim 12, wherein the retracting mechanism includes a spring.

14. The retractable baffler of claim 10, wherein the stop member is disposed on the retractable panel at an intermediated location between the proximal end and the distal end.

15. The retractable baffler of claim 10, wherein the first support member defines a slot whose surrounding structure is the catch member.

16. A retractable barrier comprising:

a first support member a take-up member supported by the first support member;

a second support member spaced apart from the first support member;

a retractable panel that includes a proximal end attached to the take-up member and a distal end that can be releasably coupled to the second support member, wherein the retractable panel can selectively retract onto the take-up member and extend out toward the second support member and wherein the retractable panel includes an upper strap and a lower strap with a web extending therebetween, wherein the upper strap and the lower strap have a greater ultimate tensile strength than the web;

a stop member disposed on the retractable panel; and a catch member disposed on the first support member and being associated with the stop member such that the catch member impedes the movement of the stop member to limit an extent to which the retractable panel can extend out from the first support member.

17. The retractable baffler of claim 16, wherein the retractable panel includes an intermediate strap interposed between the upper strap and the lower strap, wherein the intermediate strap has a greater ultimate tensile strength than the web.

18. The retractable baffler of claim 16, wherein the retractable panel is a roll-up panel, and the take-up member is a roller that can be rotated to selectively take up and pay out the roll-up panel.

19. The retractable baffler of claim 18, further comprising a retracting mechanism coupled to the roller for urging the roller to take up the rollup panel.

20. The retractable baffler of claim 19, wherein the retracting mechanism includes a spring.

21. The retractable baffler of claim 16, wherein the stop member is disposed on the retractable panel at an intermediated location between the proximal end and the distal end.

22. The retractable baffler of claim 16, wherein the first support member defines a slot whose surrounding structure is the catch member.

23. A retractable barrier comprising:

a first support member;

a take-up member supported by the first support member;

a second support member spaced apart from the first support member;

a retractable panel that includes a proximal end attached to the take-up member and a distal end that can be releasably coupled to the second support member, wherein the retractable panel can selectively retract onto the take-up member and extend out toward the second support member and wherein the retractable panel is selectively movable to a stored position, a blocking position, and an impacted position, wherein the distal end is separated from the second support member when the retractable panel is in the stored position, the distal end is coupled to the second support member when the retractable panel is in the blocking position, and the distal end is coupled to the second support member when the retractable panel is in the impacted position; however, in the blocking position more of the retractable panel is taken up by the take-up member than when the retractable panel is in the impacted position, whereby the retractable panel incrementally extends from the first support member as the retractable panel moves from the blocking position to the impacted position;

a stop member disposed on the retractable panel; and a catch member disposed on the first support member and being associated with the stop member such that the catch member impedes the movement of the stop member to limit an extent to which the retractable panel can extend out from the first support member.

24. A retractable baffler, comprising:

a first support member;

a roller supported by the first support member;

a second support member spaced apart from the first support member;

a rollup panel that includes a proximal end attached to the roller and a distal end that can be releasably coupled to the second support member, wherein the roller can be rotated to selectively take up and pay out the rollup panel;

a retracting mechanism coupled to the roller for urging the roller to take up the rollup panel;

a vertically elongate stop member carried by the rollup panel such that the stop member is disposed at an intermediate position between the proximal end and the distal end; and a catch member disposed on the first support member and being associated with the stop member such that the catch member impedes the movement of the stop member to limit an extent to which the roller can pay out the rollup panel.

25. The retractable baffler of claim 24, wherein the stop member is disposed at an intermediate position between the proximal end and the distal end.

26. The retractable baffler of claim 24, wherein the first support member defines a slot whose surrounding structure is the catch member.

27. A retractable barrier comprising:

a first support member;

a roller supported by the first support member;

a second support member spaced apart from the first support member;

a rollup panel that includes a proximal end attached to the roller and a distal end that can be releasably coupled to the second support member, wherein the roller can be rotated to selectively take up and pay out the rollup panel;

a retracting mechanism coupled to the roller for urging the roller to take up the rollup panel;

a stop member carried by the rollup panel such that the stop member is disposed at an intermediate position between the proximal end and the distal end, wherein the rollup panel defines a plurality of sleeves in which the stop member can be selectively inserted to adjust the extent to which the roller can pay out the rollup panel; and a catch member disposed on the first support member and being associated with the stop member such that the catch member impedes the movement of the stop member to limit an extent to which the roller can pay out the rollup panel.

28. A retractable barrier comprising:

a first support member;

a roller supported by the first support member;

a second support member spaced apart from the first support member;

a rollup panel that includes a proximal end attached to the roller and a distal end that can be releasably coupled to the second support member, wherein the roller can be rotated to selectively take up and pay out the rollup panel and wherein the rollup panel includes an upper strap and a lower strap with a web extending therebetween, wherein the upper strap and the lower strap have a greater ultimate tensile strength than the web;

a retracting mechanism coupled to the roller for urging the roller to take up the rollup panel;

a stop member carried by the rollup panel such that the stop member is disposed at an intermediate position between the proximal end and the distal end; and a catch member disposed on the first support member and being associated with the stop member such that the catch member impedes the movement of the stop member to limit an extent to which the roller can pay out the rollup panel.

29. The retractable baffler of claim 28, wherein the rollup panel includes an intermediate strap interposed between the upper strap and the lower strap, wherein the intermediate strap has a greater ultimate tensile strength than the web.

30. A retractable barrier comprising:

a first support member;

a roller supported by the first support member;

a second support member spaced apart from the first support member;

a rollup panel that includes a proximal end attached to the roller and a distal end that can be releasably coupled to the second support member, wherein the roller can be rotated to selectively take up and pay out the rollup panel wherein the rollup panel is selectively movable to a stored position, a blocking position, and an impacted position, wherein the distal end is separated from the second support member when the rollup panel is in the stored position, the distal end engages the second support member when the rollup panel is in the blocking position, and the distal end engages the second support member when the rollup panel is in the impacted position; however, in the blocking position more of the rollup panel is wrapped around the roller than when the rollup panel is in the impacted position, whereby the rollup panel partially unwraps from the roller as the rollup panel moves from the blocking position to the impacted position;

a retracting mechanism coupled to the roller for urging the roller to take up the rollup panel;

a stop member carried by the rollup panel such that the stop member is disposed at an intermediate position between the proximal end and the distal end; and a catch member disposed on the first support member and being associated with the stop member such that the catch member impedes the movement of the stop member to limit an extent to which the roller can pay out the rollup panel.

31. A retractable barrier, comprising:

a first support member that includes a structure defining a slot;

a roller supported by the first support member;

a second support member that is spaced apart from the first support member;

a rollup panel that includes an upper strap, a lower strap, a web interposed therebetween, a proximal end attached to the roller, and a distal end that can be releasably coupled to the second support member, wherein the roller can be rotated to selectively take up and pay out the rollup panel, and the upper strap and the lower strap have a greater ultimate tensile strength than the web;

a retracting mechanism coupled to the roller for urging the roller to take up the rollup panel;

a stop member that is vertically elongate and carried by the rollup panel at an intermediated location between the proximal end and the distal end; and a catch member provided by the structure that defines the slot in the first support member, wherein the catch member is associated with the stop member such that the catch member impedes the movement of the stop member to limit an extent to which the roller can pay out the rollup panel, wherein the rollup panel is selectively movable to a stored position, a blocking position, and an impacted position, wherein the distal end is separated from the second support member when the rollup panel is in the stored position, the distal end is coupled to the second support member when the rollup panel is in the blocking position, and the distal end is coupled to the second support member when the rollup panel is in the impacted position; however, in the blocking position more of the rollup panel is wrapped around the roller than when the rollup panel is in the impacted position, whereby the rollup panel incrementally unwraps from the roller as the rollup panel moves from the blocking position to the impacted position.

32. A method of transferring a first reactive force responsive to an impact force of a material handling vehicle striking a rollup panel, wherein the rollup panel is part of a retractable barrier that is installed at a loading dock that includes a dock leveler, the method comprising:

anchoring a first support member and a second support member to the loading dock such that the dock leveler is interposed between the first support member and the second support member;

supporting a roller by the first support member, wherein a portion of the rollup panel is wrapped about the roller;

extending the rollup panel between the roller and the second support member; and transmitting the first reactive force through the rollup panel and through the first support member such that most of the reactive force bypasses the roller.

33. The method of claim 32, further comprising transmitting through the second support member a second reactive force that is responsive to the impact force.

34. A retractable baffler, comprising:

a first support member;

a roller supported by the first support member, wherein the roller member has an axis that is substantially vertical;

a second support member spaced apart from the first support member;

a retractable panel that includes a proximal end attached to the roller and a distal end that can be releasably coupled to the second support member, wherein the retractable panel can selectively retract onto the take-up member and extend out toward the second support member;

a stop member disposed on the retractable panel; and a catch member disposed on the first support member and being associated with the stop member such that the catch member impedes the movement of the stop member to limit an extent to which the retractable panel can extend out from the first support member.

35. A retractable baffler, comprising:

a first support member;

a take-up member supported by the first support member;

a second support member laterally spaced apart from the first support member such that a horizontal gap exists between the first support member and the second support member;

a retractable panel that includes a proximal end attached to the take-up member and a distal end that can be releasably coupled to the second support member to span the horizontal gap, wherein the retractable panel can selectively retract onto the take-up member and extend out toward the second support member;

a stop member disposed on the retractable panel; and a catch member disposed on the first support member and being associated with the stop member such that the catch member impedes the movement of the stop member to limit an extent to which the retractable panel can extend out from the first support member.

36. The retractable barrier of claim 35, wherein the take-up member is a roller.

* * * * *

UNITED STATES PATENT AND TRADEMARK OFFICE

CERTIFICATE OF CORRECTION

PATENT NO. : 7,207,370 B2
APPLICATION NO. : 10/809119
DATED : April 24, 2007
INVENTOR(S) : Snyder et al.

It is certified that error appears in the above-identified patent and that said Letters Patent is hereby corrected as shown below:

| | |
|---|---|
| Col. 6, line 27 | After “A retractable” delete “baffler” and insert -- barrier --. |
| Col. 6, line 45 | After “The retractable” delete “baffler” and insert -- barrier --. |
| Col. 6, line 49 | After “The retractable” delete “baffler and insert -- barrier --. |
| Col. 6, line 52 | After “The retractable” delete “baffler” and insert -- barrier --. |
| Col. 6, line 54 | After “The retractable” delete “baffler” and insert -- barrier--. |
| Col. 6, line 57 | After “The retractable” delete “baffler” and insert -- barrier --. |
| Col. 6, line 60 | After “The retractable” delete “baffler” and insert -- barrier --. |
| Col. 6, line 63 | After “The retractable” delete “baffler” and insert -- barrier --. |
| Col. 6, line 65 | After “The retractable” delete “baffler” and insert -- barrier --. |
| Col. 7, line 22 | After “The retractable” delete “baffler” and insert -- barrier --. |
| Col. 7, line 26 | After “The retractable” delete “baffler” and insert -- barrier --. |
| Col. 7, line 29 | After “The retractable” delete “baffler” and insert -- barrier --. |
| Col. 7, line 31 | After “The retractable” delete “baffler” and insert -- barrier --. |
| Col. 7, line 34 | After “The retractable” delete “baffler” and insert -- barrier --. |
| Col. 7, line 39 | After “a first support member” insert -- ; --. |
| Col. 7, line 59 | After “The retractable” delete “baffler” and insert -- barrier --. |
| Col. 7, line 64 | After “The retractable” delete “baffler” and insert -- barrier --. |
| Col. 8, line 1 | After “The retractable” delete “baffler” and insert -- barrier --. |
| Col. 8, line 4 | After “The retractable” delete “baffler” and insert -- barrier --. |
| Col. 8, line 6 | After “The retractable” delete “baffler” and insert -- barrier --. |
| Col. 8, line 9 | After “The retractable” delete “baffler” and insert -- barrier --. |

UNITED STATES PATENT AND TRADEMARK OFFICE

CERTIFICATE OF CORRECTION

PATENT NO. : 7,207,370 B2
APPLICATION NO. : 10/809119
DATED : April 24, 2007
INVENTOR(S) : Snyder et al.

It is certified that error appears in the above-identified patent and that said Letters Patent is hereby corrected as shown below:

| | |
|---|---|
| Col. 8, line 44 | After "A retractable" delete "baffler" and insert -- barrier --. |
| Col. 8, line 65 | After "The retractable" delete "baffler" and insert -- barrier --. |
| Col. 9, line 1 | After "The retractable" delete "baffler" and insert -- barrier --. |
| Col. 9, line 51 | After "The retractable" delete "baffler" and insert -- barrier --. |
| Col. 11, line 11 | After "A retractable" delete "baffler" and insert -- barrier --. |
| Col. 12, line 4 | After "A retractable" delete "baffler" and insert -- barrier --. |

Signed and Sealed this

Fifth Day of June, 2007

JON W. DUDAS
*Director of the United States Patent and Trademark Office*